US009618280B2

(12) United States Patent
Magnier-Cathenod et al.

(10) Patent No.: US 9,618,280 B2
(45) Date of Patent: Apr. 11, 2017

(54) PLATE-TYPE HEAT EXCHANGER, PARTICULARLY FOR MOTOR VEHICLES

(75) Inventors: Anne-Sylvie Magnier-Cathenod, Saint-Cloud (FR); Jean-Sylvain Bernard, Le Mesnil-Saint-Denis (FR); Carlos Martins, Le Chesnay (FR)

(73) Assignee: VALEO SYSTEMES THERMIQUES, Le Mesnil Saint Denis (FR)

( * ) Notice: Subject to any disclaimer, the term of this patent is extended or adjusted under 35 U.S.C. 154(b) by 769 days.

(21) Appl. No.: 12/993,456

(22) PCT Filed: May 20, 2009

(86) PCT No.: PCT/EP2009/056140

§ 371 (c)(1),
(2), (4) Date: Jan. 25, 2011

(87) PCT Pub. No.: WO2009/141379

PCT Pub. Date: Nov. 26, 2009

(65) Prior Publication Data

US 2011/0108258 A1 May 12, 2011

(30) Foreign Application Priority Data

May 22, 2008 (FR) ..... 08 02772

(51) Int. Cl.
*F28F 3/12* (2006.01)
*F28F 3/08* (2006.01)
(Continued)

(52) U.S. Cl.
CPC ..... *F28F 3/046* (2013.01); *F28D 9/005* (2013.01); *F28D 2021/0084* (2013.01); *F28F 2275/04* (2013.01)

(58) Field of Classification Search
CPC ..... F28F 3/046; F28F 2275/04; F28D 9/005; F28D 2021/0084
(Continued)

(56) References Cited

U.S. PATENT DOCUMENTS 3,157,229 A * 11/1964 Wennerberg ..... F28F 3/083 165/167
4,470,453 A * 9/1984 Laughlin ..... F28D 9/0012 165/166
(Continued)

FOREIGN PATENT DOCUMENTS

AT 393162 B 8/1991
CN 2119632 U 10/1992
(Continued)

OTHER PUBLICATIONS

English language abstract for AT393162 extracted from espacenet.com database Apr. 11, 2011, 7 pages.
(Continued)

*Primary Examiner* — Len Tran
*Assistant Examiner* — Claire Rojohn, III
(74) *Attorney, Agent, or Firm* — Howard & Howard Attorneys PLLC

(57) ABSTRACT

A heat exchanger (10) comprises an alternating stacking of first plates (12) and second plates (14) provided respectively with first corrugations (16) separated by a first pitch ($P_1$) and second corrugations (18) separated by a second pitch ($P_2$), which is different from the first pitch ($P_1$). Between the plates, first flow channels are defined having a first cross sectional area adapted to a first fluid ($F_1$) which alternate with second flow channels having a second cross sectional area adapted to a second fluid ($F_2$). The invention applies in particular to heat exchangers for motor vehicles.

19 Claims, 4 Drawing Sheets

(51) Int. Cl.
*F28F 3/04* (2006.01)
*F28D 9/00* (2006.01)
*F28D 21/00* (2006.01)

(58) Field of Classification Search
USPC ..... 165/164, 165, 166, 167, 170
See application file for complete search history.

(56) References Cited

U.S. PATENT DOCUMENTS

| | | | | |
|---|---|---|---|---|
| 4,781,248 | A * | 11/1988 | Pfeiffer | 165/167 |
| 5,398,751 | A | 3/1995 | Blomgren | |
| 5,512,250 | A * | 4/1996 | Betta | F01N 3/28 165/166 |
| 6,016,865 | A * | 1/2000 | Blomgren | F28D 9/0043 165/148 |
| 6,164,372 | A | 12/2000 | Persson | |
| 6,182,746 | B1 * | 2/2001 | Wiese | 165/166 |
| 6,237,679 | B1 | 5/2001 | Vestergren | |
| 6,911,631 | B2 * | 6/2005 | Nilsson | F24H 1/121 165/167 |
| 7,032,654 | B2 * | 4/2006 | Wand et al. | 165/133 |
| 7,426,957 | B2 * | 9/2008 | Hendrix | F28D 9/005 165/166 |
| 7,775,264 | B2 * | 8/2010 | Andersson | F28D 9/005 165/134.1 |
| 8,061,416 | B2 | 11/2011 | Geskes et al. | |
| 2005/0211421 | A1 * | 9/2005 | Ekelund | F28D 9/005 165/114 |
| 2006/0053833 | A1 * | 3/2006 | Martins | F25B 39/04 62/507 |
| 2008/0029257 | A1 | 2/2008 | Nilsson | |
| 2008/0078538 | A1 * | 4/2008 | Jalilevand | F28D 1/0333 165/170 |
| 2012/0234523 | A1 * | 9/2012 | Jouanny | F28D 9/005 165/166 |

FOREIGN PATENT DOCUMENTS

| | | | | |
|---|---|---|---|---|
| CN | 1399117 | A | 2/2003 | |
| DE | 29616354 | U1 | 1/1997 | |
| DE | 19712154 | A1 * | 9/1998 | B01D 46/10 |
| DE | 198 58 652 | A1 | 6/1999 | |
| DE | 60 2004 004 114 | T2 | 7/2007 | |
| EP | 1630510 | A1 * | 3/2006 | F28F 3/04 |
| FR | 2 821 926 | A1 | 9/2002 | |
| FR | 2876179 | A1 | 4/2006 | |
| GB | 1 486 919 | | 9/1977 | |
| JP | H 11-173771 | A | 7/1999 | |
| JP | H 11-281283 | A | 10/1999 | |
| WO | WO 2005/012820 | A1 | 2/2005 | |

OTHER PUBLICATIONS

English language abstract for DE 19712154 extracted from espacenet.com database Apr. 11, 2011, 5 pages.
English language abstract for DE 29616354 extracted from espacenet.com database Apr. 11, 2011, 11 pages.
English language abstract for FR 2876179 extracted from espacenet.com database Apr. 11, 2011, 28 pages.
PCT International Search Report for PCT/EP2009/056140 dated Sep. 2, 2009, 5 pages.
English language abstract and machine-assisted English translation for CN 2119632 extracted from espacenet.com database on Feb. 4, 2016, 6 pages.
English language abstract and machine-assisted English translation for CN 1399117 extracted from espacenet.com database on Feb. 4, 2016, 8 pages.
English language abstract for DE 198 58 652 extracted from espacenet.com database on Feb. 4, 2016, 1 page.
English language abstract for DE 60 2004 004 114 extracted from espacenet.com database on Feb. 4, 2016, 1 page.
English language abstract and machine-assisted English translation for FR 2 821 926 extracted from espacenet.com database on Feb. 4, 2016, 11 pages.
English language abstract and machine-assisted English translation for JPH 11-173771 extracted from espacenet.com database on Feb. 4, 2016, 30 pages.
English language abstract and machine-assisted English translation for JPH 11-281283 extracted from espacenet.com database on Feb. 4, 2016, 9 pages.
English language abstract for WO 2005/012820 extracted from espacenet.com database on Feb. 4, 2016, 2 pages.

* cited by examiner

PLATE-TYPE HEAT EXCHANGER, PARTICULARLY FOR MOTOR VEHICLES

RELATED APPLICATIONS

This application claims priority to and all the advantages of International Patent Application No. PCT/EP2009/056140, filed on May 20, 2009, which claims priority to French Patent Application No. FR 08/02772, filed on May 22, 2008.

The invention relates to heat exchangers, particularly for motor vehicles.

It relates more specifically to a heat exchanger of the type comprising an alternating stacking of first plates and second plates provided respectively with first corrugations and second corrugations so as to define, between the plates, first flow channels for a first fluid which alternate with second flow channels for a second fluid.

In a heat exchanger of this kind, the first plates and the second plates are provided with lined-up through-openings defining paths for allowing the first fluid to supply the first flow channels and the second fluid to supply the second flow channels.

This kind of heat exchanger is usually made by brazing together in a sealed assembly the respective raised edges of each of the plates.

Stacked-plate heat exchangers are used particularly as oil exchangers, for instance for cooling the engine oil or transmission oil of motor vehicles. They are also used for water condensers, in which a refrigerant is cooled by water, which is usually the engine cooling water.

The plates may come in different geometrical shapes, such as rectangular, and are usually provided with reliefs intended to be brazed to each other for mechanical strength. These reliefs also serve to interfere with the flow of the fluid and to increase the heat exchange area.

In most known versions, the plates used are identical or symmetrical. This means that the cross sectional areas of the first, flow channels and the second flow channels are identical.

It is also known practice, from EP 1 630 510, to provide stacked plates that allow for different cross sectional areas for the first and second flow channels, and hence for the two fluids that exchange heat with each other.

The above publication teaches for this purpose the provision of symmetrical plates having dissimilar corrugations, e.g. one large corrugation alternating with two small corrugations. However, in that known solution the small corrugations never pass through the neutral line of the plate, meaning the midplane of the plate. As a consequence, each small corrugation does not come into contact with another small corrugation, and the result is that the pressure resistance is provided only by the thickness of the plate. Since these plate heat exchangers can in certain applications be carrying fluids operating at high pressure, for example of the order of one hundred bar, they must be able to mechanically withstand such pressure values.

It is a particular object of the invention to overcome the abovementioned disadvantages.

It aims principally to provide a heat exchanger of the type indicated above that allows the respective cross sectional areas of the first and second. flow channels to be adapted to the two fluids employed, especially with regards their flowrates and their physical properties.

The invention also aims to provide a heat exchanger of the type indicated above that offers enhanced pressure resistance for each of the first and second flow channels due to an appropriate configuration of the corrugations.

To this end, the invention. provides a plate heat exchanger, as defined in the introduction, in which the first corrugations are separated by a first pitch $P_1$ while the second corrugations are separated by a second pitch $P_2$, which is different from the first pitch, thus allowing the first channels and the second channels to define a first cross sectional area and a second, different cross sectional area that are suitable for the first fluid and for the second fluid, respectively.

This suitability is thus decided by selecting appropriate values for the first pitch and the second pitch.

The first corrugations are in principle identical to each other and the same applies to the second corrugations. This avoids the need to make different corrugations within a given plate, as is required in the abovementioned publication EP 1 630 510.

Thus, through the selection of the values of the pitches $P_1$ and $P_2$, it is possible to make the cross sectional area of the first, channels and that of the second channels suitable for the first fluid and the second fluid, respectively, on the basis of the properties of these two fluids.

The pressure resistance of the first and second channels is ensured by having all the corrugations passed through the neutral line of the respective plates, notably by having the corrugations all on the same side of said neutral line.

In the following detailed description, which is given purely by way of example, reference is made to the appended drawings, in which.

Figure 1:
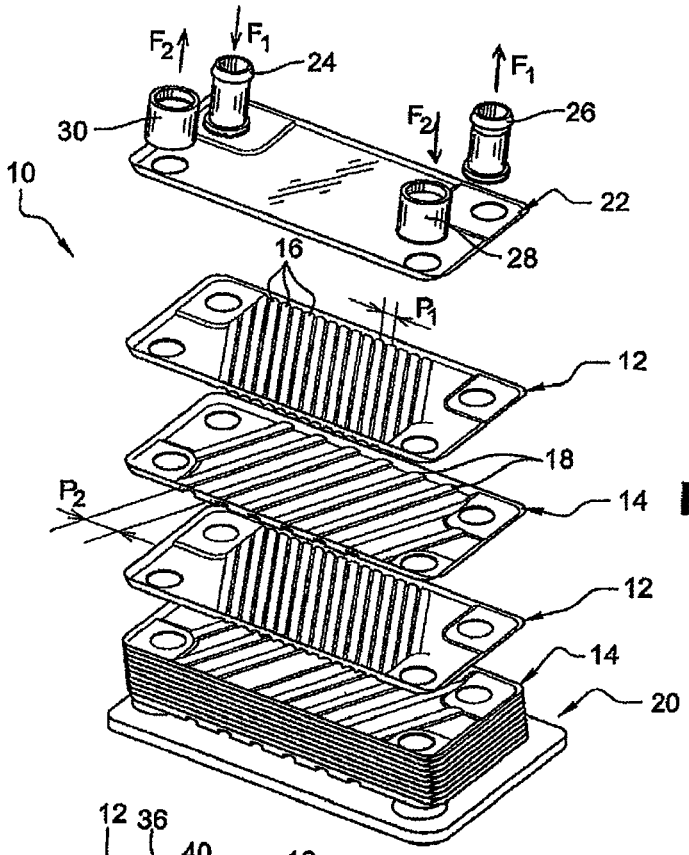
FIG. 1 is an exploded perspective view of a plate heat exchanger in a first embodiment of the invention.

The heat exchanger 10 shown in FIG. 1 comprises an alternating stacking of first plates 12 and second plates provided respectively with first corrugations 16 and second corrugations 18. This stacking lies between two end plates, namely a bottom plate 20, which is closed, and a top plate 22, which has two nozzles 24 and 26 for the inlet and outlet of a first fluid $F_1$ and two other nozzles 28 and 30 for the inlet and outlet of a second fluid $F_2$.

The first plate 12 (FIG. 2) has a flat base 32, of generally rectangular shape in the example, defining a neutral line through which the first corrugations 16 pass. All the corrugations pass through the base 32.

Figure 2:
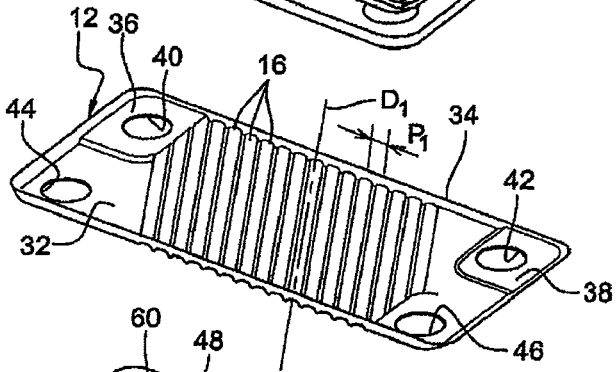
FIG. 2 is a perspective view of a first plate from the heat exchanger of FIG. 1, where the corrugations are straight and spaced out at a first pitch $P_1$.
Figure 3:
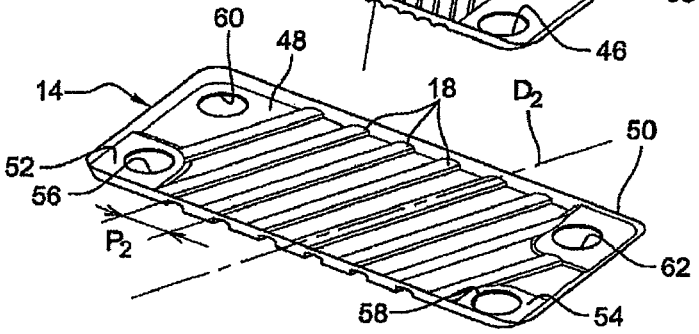
FIG. 3 is a perspective view of a second plate from the heat exchanger of FIG. 1, where the corrugations are straight and spaced out at a second pitch $P_2$.

In the example, these first corrugations 16 propagate in a straight line parallel to a first direction $D_1$ that extends obliquely relative to the sides of the rectangle defined by the base 32 of the plate. In FIG. 2 the corrugations 16 are identical to each other and spaced out at a first pitch $P_1$.

The base 32 is surrounded by a raised peripheral edge 34, in the form of a taper, to allow it to be assembled to corresponding raised edges on adjacent second plates, as will be seen below.

The base of the plate additionally includes two elevations 36 and 38 adjacent to one long side of the rectangle and containing respective openings 40 and 42. These two elevations are flat and raised above the plane defined by the base 32 of the plate. The base 32 has two other openings 44 and 46 adjacent to the other long side, these latter openings being formed directly in the base 32 of the plate. The openings 40, 42, 44 and 46 are circular.

The second plate 14 is made in a corresponding way. It has a flat base 48 defining a neutral line through which the second corrugations 18 pass. These corrugations propagate in a straight line parallel to a second direction $D_2$ that extends obliquely relative to the sides of the rectangle defined by the base 48. The corrugations 18 are parallel to each other and spaced out at a second pitch $P_2$ which is greater than the pitch $P_1$.

As in the case of the first plate 12, the plate 14 is surrounded by a tapering raised peripheral edge 50 to allow mutual assembly of the plates by nesting and brazing their respective peripheral edges.

The corrugations of said first and second plates may for example be of identical height, that is a dimension in the direction perpendicular to the plane of extension of said plates. The nesting angle of said plates is thus the same for all the plates.

The height of said peripheral edges is decided as a function of the value of the nesting angle and the thickness of material of the plates in order to allow nesting with contact between the raised peripheral edges of adjacent plates when said plates are assembled. The height of the corrugations is adapted to ensure contact between one plate and the next without however limiting the nesting, so as to ensure a constant nesting angle.

The flat base 48 comprises two elevations 52 and 54 adjacent to one long side of the rectangle and provided with respective openings 56 and 58. The base 48 also includes two openings 60 and 62 formed adjacent to the other long side of the rectangle, these openings being made directly in the base 48. The openings 56, 58, 60 and 62 are circular. The pack made of the first plates, the second plates, and the end plates can be assembled by brazing in a single operation.

In this way a multiplicity of alternating channels is defined for the flow of the first fluid $F_1$, which alternate with a multiplicity of channels for the flow of the fluid $F^2$. The nozzle 24 is coaxial with the openings 40 and 60, which are aligned, to define an admission path. The nozzle 26 is coaxial with the openings 42 and 62, which are aligned, to define an admission path. The nozzle 28 is coaxial with the openings 46 and 58, which are aligned, to define an admission path. Lastly, the nozzle 30 is coaxial with the openings 44 and 56, which are aligned, to define an admission path.

In the stacking, the corrugations 16 of a first plate each intersect the corrugations 18 of the adjacent second plates, with the result that the first corrugations and the second corrugations intersect each other and come into contact with each other via their respective peaks. These peaks are brazed in the brazing operation, thus ensuring enhanced mechanical strength of the plates at pressure.

Because of the fact that the pitches $P_1$ and $P_2$ are different, the cross sectional areas defined by the first channels and the second channels are different and can be adapted by an appropriate selection of the values of the pitches $P_1$ and $P_2$. Advantageously, the ratio $P_1/P_2$ of the first pitch $P_1$ to the second pitch $P_2$ is between 1 and 6 with P1 P2. Advantageously, this ratio is a fraction, for example ½, ⅔, etc.

In the example of FIG. 1, this ratio is ½.

The difference between the cross sectional areas of the flow channels will be explained further in the second embodiment shown in FIGS. 4 to 12.

In this second embodiment, parts corresponding to parts in the first embodiment are given the same reference numbers increased by 100.

Figure 4:
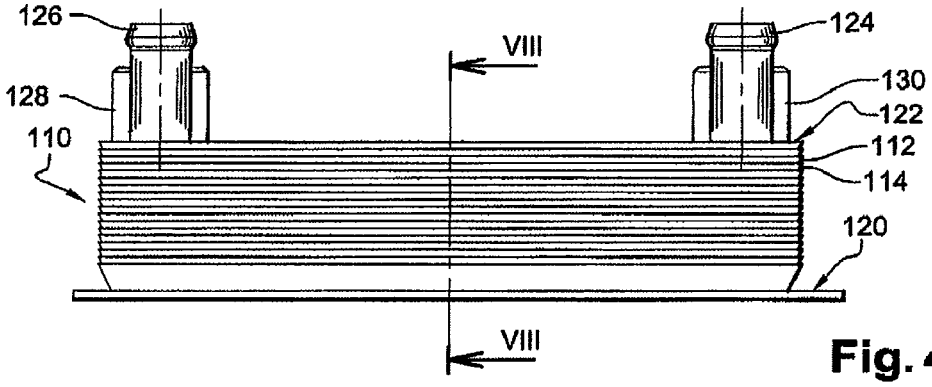
FIG. 4 is a side view of a plate heat exchanger in a second embodiment of the invention.

FIG. 4 is a side view of the heat exchanger 110 in the second embodiment.

Figure 5:
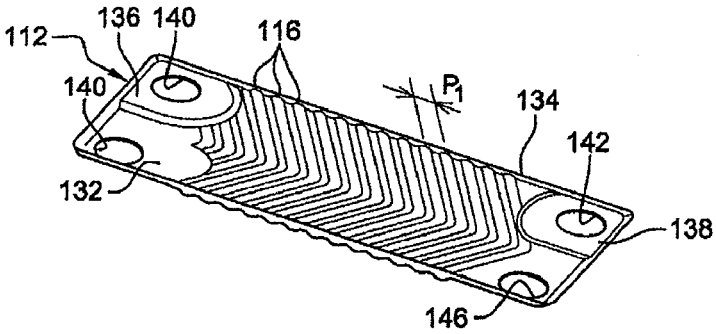
FIG. 5 is a perspective view of a first plate from the heat exchanger of FIG. 4, with the chevron corrugations spaced out at a first pitch $P_1$.
Figure 6:
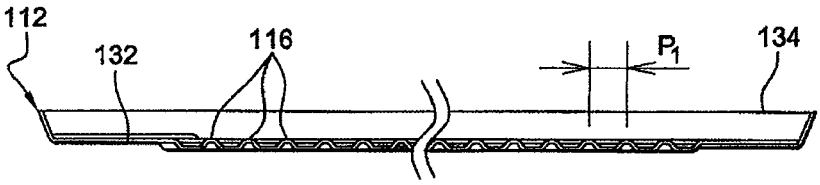
FIG. 6 is a longitudinal section through the first plate seen in FIG. 5.

FIG. 5 shows a first plate 112 that corresponds to the plate 12 in FIG. 2, the main difference being that the corrugations 116 propagate in a chevron pattern, i.e. they are shaped like Vs nested in each other. These corrugations are identical to each other and spaced out at a pitch $P_1$ as can be seen in FIG. 5 and as can be seen also in the section in FIG. 6. The corrugations 116 pass through the neutral line defined by the base 132 of the plate 116.

Figure 7:
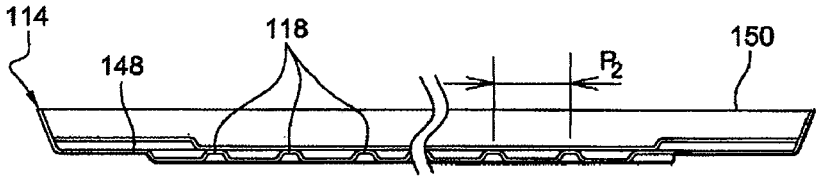
FIG. 7 is a longitudinal section through a second plate from the heat exchanger of FIG. 4.

The second plate 114 is not shown in perspective, but only in section in FIG. 7. It comprises second corrugations 118 that propagate in a chevron pattern but with a different orientation to that of the corrugations 116 of the plate 112. Specifically, the respective chevrons of plates 112 and 114 propagate in mutually opposite directions in such a way that the first corrugations and the second corrugations intersect and are in contact via their respective peaks. These respective peaks are intended to be brazed during the brazing of the stacked plates to ensure enhanced mechanical strength.

As can be seen in the sectional view in FIG. 7, the corrugations 118 are separated by a second pitch $P_2$, which in the example is twice the pitch $P_1$. As a result, the ratio $P_1$ over $P_2$ is also ½ as in the first embodiment.

Figure 8:
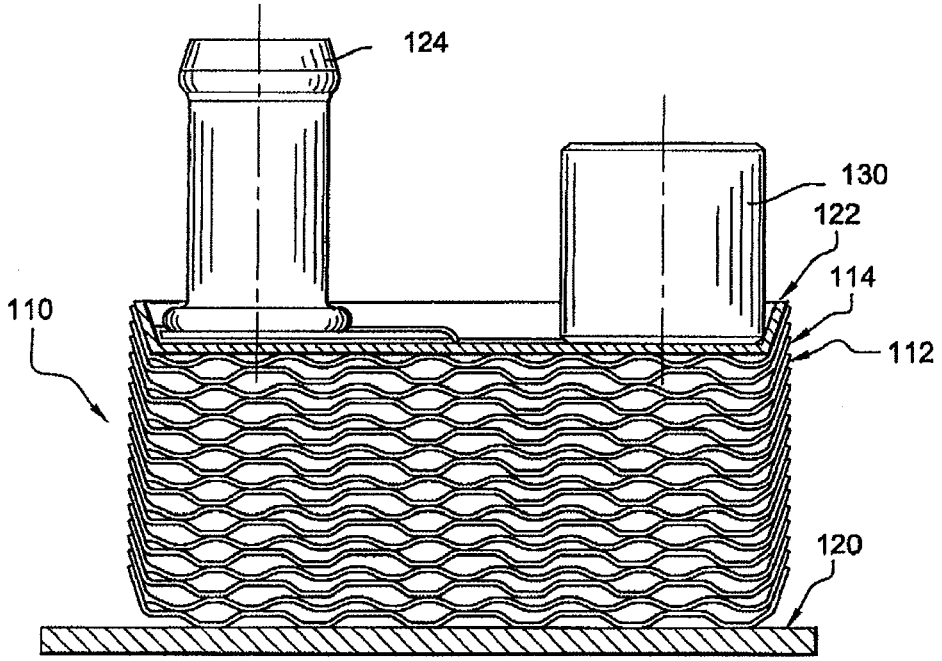
FIG. 8 is a section, on a larger scale, on VIII-VIII as marked in FIG. 4.

The view in section in FIG. 8 shows the alternating stacking of the plates 112 and 114, between a bottom plate 120 and a top plate 122 which comprises the nozzles 124, 126, 128 and 130 (see also FIG. 4). FIG. 8 also shows the cross sectional areas of the respective flow channels defined between the plates 112 and 114.

Figure 9:
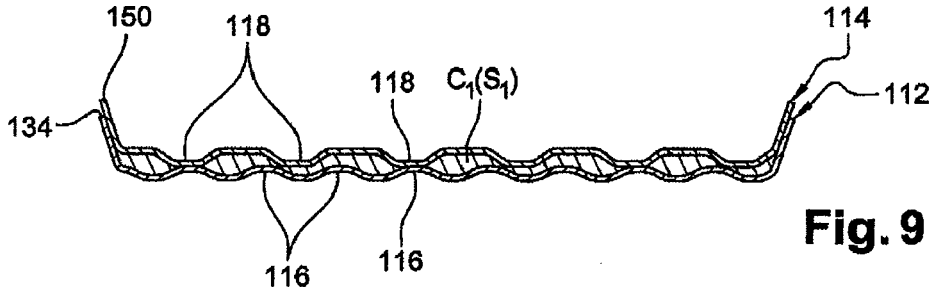
FIG. 9 is a partial section through the FIG. 8 section showing a second plate superposed on top of a first plate.

FIG. 9 shows a first plate 112 with corrugations 116 spaced out at a pitch $P_1$. Placed on this is a second plate 114 with corrugations 118 spaced out at a pitch $P_2$. It will be seen that the corrugations 116 and 118 contact each other via their respective peaks, every third peak in the case of the corrugations 116 and every second peak in the case of the corrugations 118, due to the selected ratio $P_1/P_2$. Defined between the plates 112 and 114 are first flow channels $C_1$ whose cross sectional area $S_1$ is indicated by hatched lines.

Figure 10:
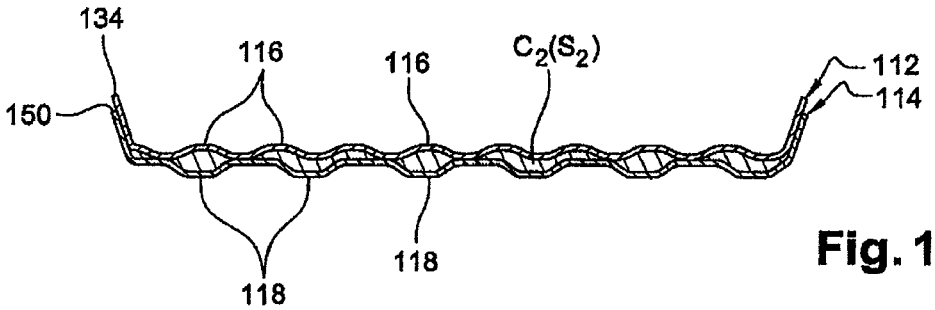
FIG. 10 is a partial section through the FIG. 8 section showing a first plate superposed on top of a second. plate.

FIG. 10 shows the reverse configuration in which the first plate 112 is placed on top of a second plate 114. In this case, second flow channels $C_2$ are defined between these plates and its cross sectional area $S_2$ is indicated by hatched lines. If FIGS. 9 and 10 are compared, it will be seen that the cross sectional area $S_1$ of the first channels $C_1$ (FIG. 9) is greater than the cross sectional area $S_2$ of the second channels $C_2$ (FIG. 10). Thus, by selecting appropriate values for the pitches $P_1$ and $P_2$, the values of these cross sectional areas can be varied and made suitable for the fluid in question.

For example, in the case of a condenser traversed by a high pressure (typically 110 bar) refrigerant and by lowpressure (typically 1 to 2 bar) coolant water, the refrigerant will be passed through the smallest cross sectional area, which is the channels $C_2$ (FIG. 10). On the other hand the fluid operating at lower pressure, in this case the water, will pass through the largest cross sectional area, which is the flow channels $C_1$ (FIG. 9). The water corresponds in this case to the fluid $F_1$ entering through the nozzle 124 and exiting through the nozzle 126, while the refrigerant corresponds to the fluid $F_2$ entering through the nozzle 128 and exiting through the nozzle 130. Thus, out of the first cross sectional area $S_1$ and the second cross sectional area $S_2$, whichever is the smallest is suitable for whichever, out of the first fluid $F_1$ and the second fluid $F_2$, is operating at the highest pressure.

Figure 11:
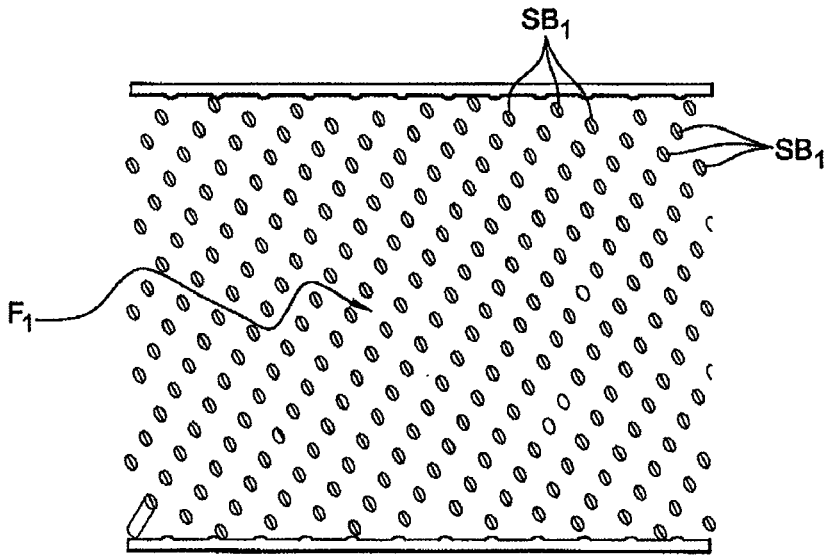
FIG. 11 illustrates the brazing surfaces between the plates from FIGS. 9.
Figure 12:
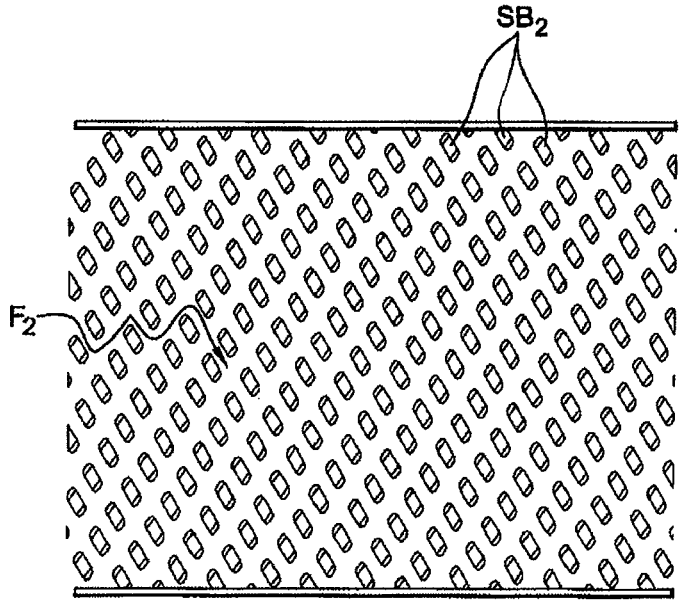
FIG. 12 illustrates the brazing surfaces between the plates from FIG. 10.

FIG. 11 shows the brazing surfaces $SB_1$ between the plates 112 and 114 in the configuration shown in FIG. 9, while FIG. 12 shows the brazing surfaces $SB_2$ between the first plate 112 and the second plate 114 in the configuration shown in FIG. 10.

In the surfaces $SB_1$ of FIG. 11 are more limited than the surfaces $SB_2$ of FIG. 12. The lower-pressure fluid, which in this case is fluid $F_1$, can propagate between the brazing surfaces $SB_1$ as the arrow in FIG. 11 shows.

However, in the case of FIG. 12, the higher-pressure fluid $F_2$ can propagate between the brazing surfaces $SB_2$ as the arrow shows.

In the case of FIG. 11, the brazing surfaces are more limited and the cross sectional areas more expansive, which allows a lower-pressure fluid to pass through.

Conversely, in the case of FIG. 12, the brazing surfaces are more expansive, offering better resistance to the pressure for a higher-pressure fluid to pass through.

The invention is open to numerous variant embodiments, particularly as regards the general shape of the plates, and the shape and respective pitches of the corrugations of the various plates.

The preferred application of the invention is to heat exchangers for motor vehicles, and particularly to condensers traversed by a refrigerant and cooled by water.

The invention claimed is:

1. A heat exchanger comprising an alternating stacking of first plates (12; 112) and second plates (14; 114), the first plates (12; 112) including first corrugations (16; 116), and the second plates (14; 114) being different from the first plates (12; 112) and including second corrugations (14; 114) so as to define, between the alternating stack of first plates (16; 116) and second plates (18; 118), first flow channels ($C_1$) for a first fluid ($F_1$) which alternate with second flow channels ($C_2$) for a second fluid ($F_2$), characterized in that the first corrugations (16; 116) are separated from one another by a first pitch ($P_1$) that is present only on the first plates (12; 112) while the second corrugations (18; 118) are separated from one another by a second pitch ($P_2$) that is present only on the second plates (14; 114), the second pitch ($P_2$) different from the first pitch ($P_1$), thus allowing the first channels ($C_1$) and the second channels ($C_2$) to define a first cross sectional area ($S_1$) and a second cross sectional area ($S_2$) that are different from one another and suitable for the first fluid ($F_1$) and for the second fluid ($F_2$), respectively;

wherein the first cross sectional area ($S_1$) is greater than the second cross sectional area ($S_2$).

2. The heat exchanger as claimed in claim 1, characterized in that each one of the first plates (12; 112) has a flat base (32; 132) defining a neutral line through which the first corrugations (16; 116) pass.

3. The heat exchanger as claimed in claim 1, characterized in that each one of the second plates (14; 114) has a flat base (48; 148) defining a neutral line through which the second corrugations (18; 118) pass.

4. The heat exchanger as claimed in claim 1, characterized in that each one of the first corrugations (16) propagates in a straight line across the entire width of the corresponding first plate (12) and parallel to a first direction ($D_1$), and in that each one of the second corrugations (18) propagates in a straight line across the entire width of the corresponding second plate (14) and parallel to a second direction ($D_2$), that extends angularly relative to the first direction $D_1$ in such a way that the first corrugations (16) and the corresponding second corrugations (18) intersect and are in contact with one another via their respective peaks.

5. The heat exchanger as claimed in claim 1, characterized in that each one of the first corrugations (116) propagates in a chevron pattern and in that each one of the second corrugations (118) propagates in a chevron pattern in a mutually opposite direction with respect to a corresponding one of the first corrugations (118), in such a way that the first corrugations (116) and the corresponding second corrugations (118) intersect and are in contact with one another via respective peaks.

6. The heat exchanger as claimed in claim 1, characterized in that the ratio ($P_1/P_2$) of the first pitch ($P_1$) to the second pitch ($P_2$) is between 1 and 6, with $P_1 < P_2$.

7. The heat exchanger as claimed in claim 6, characterized in that the ratio ($P_1/P_2$) of the first pitch ($P_1$) to the second pitch ($P_2$) is a fraction.

8. The heat exchanger as claimed in claim 1, characterized in that each one of the first plates (12; 112) and each one of the second plates (14; 114) is provided with a tapering raised peripheral edge (34; 134; 50; 150) to allow mutual assembly of the first plates (12; 112) and the second plates (14; 114) by nesting and brazing their respective peripheral edges.

9. The heat exchanger as claimed in claim 1, characterized in that each one of the first plates (12; 112) and each one of the second plates (14; 114) are of generally rectangular shape.

10. The heat exchanger as claimed in claim 1, characterized in that each one of the first plates (12; 112) and each one of the second plates (14; 114) are provided with corresponding openings (40, 42, 44, 46; 56, 58, 60, 62; 140, 142, 144, 146; 156, 158, 160, 162) for the passage of the first fluid ($F_1$) and the second fluid ($F_2$).

11. The heat exchanger as claimed in claim 1, characterized in that it comprises a first closed end plate (20; 120) and a second end plate (22; 12), the latter provided with two nozzles (24, 26; 124, 126) for the inlet and outlet of the first fluid ($F_1$) and two other nozzles (28, 30; 128, 130) for the inlet and outlet of the second fluid ($F_2$).

12. The heat exchanger as claimed in claim 1, characterized in that the smallest out of the first cross sectional area ($S_1$) and the second cross sectional area ($S_2$) allows passage of whichever fluid ($F_1$; $F_2$) out of the first fluid ($F_1$) and the second fluid ($F_2$) that is operating at the highest pressure.

13. The heat exchanger as claimed in claim 1, characterized in that it is made in the form of a condenser suitable for carrying a refrigerant and a cooling fluid.

14. The heat exchanger as claimed in claim 2, characterized in that each one of the second plates (14; 114) has a flat base (48; 148) defining a neutral line through which the second corrugations (18; 118) pass.

15. The heat exchanger as claimed in claim 6, characterized in that the ratio ($P_1/P_2$) of the first pitch ($P_1$) to the second pitch ($P_2$) is ½.

16. The heat exchanger as claimed in claim 2, characterized in that each one of the first plates (12; 112) has a generally rectangular shape and includes two flat elevations (36, 38) adjacent to one long side of the corresponding rectangular first plate (12; 112), wherein the two flat elevations (36, 38) are raised above a plane defined by the flat base (32; 132).

17. The heat exchanger as claimed in claim 3, characterized in that each one of the second plates (14; 114) has a generally rectangular shape and includes two flat elevations (52, 54) adjacent to one long side of the corresponding rectangular second plate (14; 114), wherein the two flat elevations (52, 54) are raised above a plane defined by the flat base (48; 148).

18. The heat exchanger as claimed in claim 1, characterized in that each one of the first plates (12; 112) and each corresponding one of the second plates (14; 114) have a first plurality of brazing surfaces ($SB_1$) therebetween for the corresponding first channels ($C_1$), and each one of the first plates (12; 112) and each corresponding one of the second plates (14; 114) have a second plurality of brazing surfaces ($SB_2$) for the corresponding second channels ($C_2$), wherein the second plurality of brazing surfaces ($SB_2$) is configured to have a larger resistance to a pressure for a fluid to pass therethrough as compared to the first plurality of brazing surfaces ($SB_1$).

19. A condenser able to be traversed by a refrigerant and a coolant, the condenser comprising:

an alternating stack of first plates (12; 112) and second plates (14; 114) respectively provided with first corrugations (16; 116) and with second corrugations (18; 118) so as to define, between the plates, first flow channels ($C_1$) for a first fluid ($F_1$) which alternate with second flow channels ($C_2$) for a second fluid ($F_2$), the first corrugations (16; 116) being mutually distant by a first pitch ($P_1$) while the second corrugations (18; 118) are mutually distant by a second pitch ($P_2$), which is different from the first pitch ($P_1$), thereby allowing the first channels ($C_1$) and the second channels ($C_2$) to respectively define a first cross sectional area ($S_1$) and a second cross sectional area ($S_2$) which are different from one another and adapted to a respective one of the first fluid ($F_1$) and to the second fluid ($F_2$), the first corrugations (16; 116) of the first plates (12, 112) intersecting with the second corrugations (18; 118) of the adjacent second plates (14; 114) in such a way that the first corrugations (16; 116) and the second corrugations (18; 118) cross one another and come into contact with one another via respective peaks, the peaks being brazed, where the first cross sectional area ($S_1$) and the second cross sectional area ($S_2$), which is smaller than the first cross sectional area ($S_1$), are adapted to a respective one of the first fluid ($F_1$) and to the second fluid ($F_2$) which operates at the higher pressure, and where the brazing surfaces ($SB_2$) between a first plate (12; 112) and a second plate (14, 114) defining the second channels ($C_2$) are wider than the brazing surfaces ($SB_1$) between a first plate (12; 112) and a second plate (14; 114) defining the first channels ($C_1$), thereby allowing a better resistance to pressure for the passage of a high-pressure fluid through the second channels ($C_2$).

* * * * *